US006256817B1

(12) United States Patent
McGuire et al.

(10) Patent No.: US 6,256,817 B1
(45) Date of Patent: Jul. 10, 2001

(54) PORTA-ZAM GYNECOLOGICAL EXAM CHAIR

(75) Inventors: Bernard F. McGuire, Clearwater; Anna K. Parsons, Tampa, both of FL (US)

(73) Assignee: University of South Florida, Tampa, FL (US)

( * ) Notice: Subject to any disclaimer, the term of this patent is extended or adjusted under 35 U.S.C. 154(b) by 0 days.

(21) Appl. No.: 09/175,551

(22) Filed: Oct. 20, 1998

Related U.S. Application Data

(60) Provisional application No. 60/062,590, filed on Oct. 20, 1997.

(51) Int. Cl.[7] ..... A61G 13/12

(52) U.S. Cl. ..... 5/619; 5/602; 5/620; 5/624; 297/324.13; 297/423.37

(58) Field of Search ..... 5/602, 619, 620, 5/621, 622, 624; 297/354.13, 284.11, 423.3, 423.37, 188.11

(56) References Cited

U.S. PATENT DOCUMENTS

| | | | | |
|---|---|---|---|---|
| D. 278,668 | | 5/1985 | Simpkins . | |
| 677,181 | * | 6/1901 | Dardano | 5/624 X |
| 1,652,065 | * | 12/1927 | Tascarella | 297/188.11 X |
| 2,073,094 | * | 3/1937 | Bugh | 5/602 X |
| 3,711,152 | * | 1/1973 | Sirpak et al. | 297/423.3 X |
| 4,155,126 | * | 5/1979 | Classen | 297/423.3 X |
| 4,168,099 | | 9/1979 | Jacobs et al. . | |
| 4,180,062 | * | 12/1979 | Alberti et al. | 5/602 X |
| 4,225,127 | * | 9/1980 | Strutton | 5/624 X |
| 4,516,805 | | 5/1985 | Leeper et al. . | |

OTHER PUBLICATIONS

ENOCHS Power 6000 Product Literature.
Ritter 103 Examination Table Product Literature, 1993.
Peterman's Eye, Catalog of the J. Peterman Co., Summer 1996, p. 25.
Midmark 413 Power Female Procedures Chair Product Literature, 1993.
"Military physician's review health challenges of female soldiers" by Haffner, *American College of Obstetricians and Gynecologists Newsletter*, vol. 40, No. 9, Sep. 1996, pp. 1 and 10.

* cited by examiner

*Primary Examiner*—Michael F. Trettel
(74) *Attorney, Agent, or Firm*—Calfee, Halter & Griswold LLP

(57) ABSTRACT

A new and useful OB/GYN examination chair is provided, which is lightweight and collapsible for convenient transport or storage, and which is readily erected to an examination position in which it supports an OB/GYN patient in a convenient position for an OB/GYN examination or procedure. The chair comprises a collapsible structure having a seat, a back rest, a pair of armrests and a pair of substantially planar leg rests. The leg rests are spaced apart from each other to enable a patient's legs to be supported thereon in an abducted position suitable for an OB/GYN examination, and define therebetween an examination/demonstration space in which an OB/GYN caregiver can conduct an OB/GYN examination or procedure. Additionally, the seat has support structure which enables a slidable basin to be integrally connected with the seat. The chair has a seat which is relatively short in comparison to typical chairs designed as furniture pieces. Thus, the patient's perineum would be disposed substantially above the front end of the chair, and the back rest would provide the patient with lumbar and upper torso support. This feature, coupled with the spaced apart leg rests upon which the patient's feet and/or legs rest, with the patient's legs in an abducted position, provides convenient, comfortable and substantially unobstructed access by an OB/GYN caregiver to the patient's perineum, for conducting an examination or procedure (e.g. a vaginal ultrasound).

44 Claims, 13 Drawing Sheets

PORTA-ZAM GYNECOLOGICAL EXAM CHAIR

This application claims the benefit of U.S. Provisional Application No. 60/062,590, filing date Oct. 20, 1997.

TECHNICAL FIELD

The present invention relates to a portable chair which is designed to be easily collapsed to enable it to be transported or stored, and easily erected to an examination position in which it is adapted to support a patient suitably for OB/GYN examination.

BACKGROUND

OB/GYN examinations are traditionally conducted with a patient seated, reclined, or lying down on an examination bed or table, and the patient's feet supported by stirrups with her legs in an abducted position. The abducted position enables an OB/GYN caregiver to conduct an examination or treatment procedure, e.g. a vaginal ultrasound procedure. When the patient is supine, with her hips and knees flexed, and legs abducted, the examination position is referred to as a dorsal lithotomy position. When the patient is partially reclined with her legs abducted, the position is referred to herein as a modified dorsal lithotomy position. The examination bed or table is typically equipped with instrument and medical supply holders, and with basins for collection of fluids.

In the applicants' experience, OB/GYN examination beds and tables are generally large, heavy, and designed to be maintained at a fixed location. They are not easily transported (especially by a single individual), and are often at least semi permanently fixed in place in the examination facility. The stirrups may be attached to the bed or table, or to other equipment (or furniture) in the examination facility. Similarly, the instrument and medical supply holders, the collection basins, and other equipment needed for an OB/GYN examination, are either connected with the examination bed or table, or otherwise supported by other equipment (or furniture) in the examination facility.

In addition, in the applicants' experience, numerous situations have arisen where gynecologic examinations must be performed when a proper gynecologic examination table is not available. With the patient on a flat examination table or bed the performance of a pelvic examination is extremely difficult, if not impossible, to properly perform. The common use of pillows, bedpans, etc., to elevate the buttocks above the level of the table is uncomfortable and non-hygienic, and is often ineffective in improving the quality of the examination.

Still further, there are many instances where non-primary care givers need to perform occasional pelvic examinations, but often do not possess the room or money to install a standard gynecological exam table. For instance, vaginal ultrasound is the technique of choice for evaluation of abnormalities of the female pelvis. The performance of this biologically safe means of internal organ examination is greatly compromised when attempted with the patient laying on a flat examination surface, and the examination may be incomplete due to the limitation of movement of the probe which is inserted into the vagina.

There is an OB/GYN chair disclosed in U.S. Pat. No. 4,168,099. The chair disclosed in the patent is designed for an OB/GYN examination, and has leg supports which can support a patient's legs in an abducted position. However, the chair does not appear to be collapsible to a convenient position for transport or storage. Moreover, the chair does not appear to support a patient's legs in the same manner as the chair of the present invention.

In the applicants' experience, there is a need for an OB/GYN examination chair which is (i) collapsible to a condition in which it can be readily transported (in most instances by a single person) or take up a relatively small amount of storage space, (ii) easily erected to an examination position in which it can conveniently support a patient for an OB/GYN examination or procedure, (iii) adapted to adjust the position of the patient in the examination position, (iv) adapted to support medical instruments and supplies necessary for an OB/GYN examination or procedure, and (v) designed to be comfortable for the patient. The chair of the present invention is believed to accomplish all of the foregoing objectives.

SUMMARY OF THE PRESENT INVENTION

The present invention provides a new and useful chair which is collapsible for convenient transport or storage, and which is readily erected to an examination position in which it supports an OB/GYN patient in a convenient position for an OB/GYN examination or procedure. A chair according to the present invention is believed useful in mobile clinics and hospitals, especially those for which no purposely designed OB/GYN bed, table or chair exists. A chair according to the invention is also believed to be useful for non OB/GYN facilities (e.g. radiology facilities) where OB/GYN procedures are occasionally performed, and for conducting OB/GYN demonstrations at conferences, seminars, and other types of meeting/educational events in non-clinical settings.

In one of its basic aspects, the present invention comprises a collapsible chair structure having a seat, a back rest, a pair of armrests and a pair of leg rests. The collapsible chair structure can be made primarily of wood or one or more other strong, light weight materials such as aluminum. The chair is moveable between a collapsed condition for storage and/or transport and an examination position in which it enables a patient to be supported in a position suitable for an OB/GYN examination. When the chair is in the examination position (i) the seat and back rest are adapted to provide support for a patient's torso with suitable lumbar support; (ii) the pair of arm rests are spaced apart and oriented to provide support for a patient's arms; and (iii) the pair of leg rests extend forward of (and slightly above) the pair of arm rests and the seat. The leg rests are spaced apart from each other and effectively provide comfortable foot or leg rests which enable a patient's legs to be supported in an abducted position suitable for an OB/GYN examination, and the leg rests define therebetween an examination/demonstration space in which an OB/GYN caregiver can conduct an OB/GYN examination or procedure.

Preferably, the back rest is adjustable for supporting a patient's torso between a dorsal lithotomy position in which the patient's back is substantially horizontal, and a modified dorsal lithotomy position in which the patient's torso is reclined. Also, the seat, back rest, arm rests and leg rests preferably are integrally linked with each other in a manner that enables the chair to be easily collapsed for transport and/or storage and then erected to the examination position. Additionally, the seat preferably has support structure which enables a slidable basin to be integrally connected with the seat, and the arm rests preferably have support structure for medical supplies for an OB/GYN examination.

Still further, according to the preferred embodiment, the chair according to the present invention has a seat which is relatively short in comparison to typical chairs designed as furniture pieces. Specifically, the seat has a front end and a rear end, and the back rest extends away from the rear end of the seat. The length of the seat, i.e., from the front end to the rear end, is about one half the length of a typical furniture chair, so that when the patient is seated and her feet or legs are supported on the leg rests, the patient's lumbar region and upper torso are supported by the back rest, and the patient's perineum (for an a significant range of OB/GYN patient sizes) would be disposed substantially above the front end of the chair without requiring her to move down to reach the edge, as with a seat having a conventional length. In that position in the chair according to the present invention, the patient is well positioned, and comfortably supported, for an OB/GYN examination or procedure. It is also contemplated that the front end of the chair could be specially shaped (e.g. with a recessed area which would enhance access to the patient's perineum). In any event, the front end of the chair is dimensioned to allow convenient access to the patient's perineum. This feature, coupled with the spaced apart leg rests upon which the patient's feet or legs can rest, with her legs in an abducted position, provides convenient, and substantially unobstructed access by an OB/GYN caregiver to the patient's perineum. Hence, an OB/GYN examination or procedure (e.g. a vaginal ultrasound) can be conveniently conducted, while minimizing the risks described above with respect to compromising the examination or conducting an incomplete examination.

Moreover, the chair of the present invention is intended to be comfortable for the patient undergoing the examination or procedure, and requires a minimum of positional adjustment by the patient for the conduct of a full physical examination. More specifically, the leg rests are preferably adjustable between a retracted position and an extended position. In the extended position, the leg rests enable the patient's legs to be extended and supported on the leg rests (substantially in the manner described above). In the retracted position, the leg rests allow a caregiver to conduct an examination on a patient seated in an upright position, and do not interfere with movement of the caregiver about the patient. Also, the chair has a lower foot rest upon which a patient's feet can rest when the patient is seated in an upright position. Thus, parts of a full physical examination can be performed with a patient sitting upright with her feet resting on the lower foot support or on the ground. Other parts of a full physical examination can be performed with the patient supine, and her legs extended and resting on the spaced apart leg rests.

Thus, the present invention is believed to provide a new and useful chair which is collapsible, portable, and designed to support a patient in a convenient, comfortable position for an OB/GYN examination or procedure. Typical situations to benefit from the availability of a portable and far less expensive gynecologic examination chair would be: clinical settings, particularly radiology departments, where the demand does not offset the high price of a standard table; where space may be at a premium and a collapsible chair could easily be set-up or taken down and stored; and where transportability is important, such as with military field hospitals and remote third world clinics.

Further features and objectives of the present invention will become apparent from the following detailed description and the accompanying drawings.

DETAILED DESCRIPTION

As described above, the present invention relates to a portable, collapsible chair which can be collapsed for storage or transport, and easily erected to an examination position in which it is particularly suited for an OB/GYN examination. The following description and accompanying drawings disclose one version of such a chair.

Figure 1:
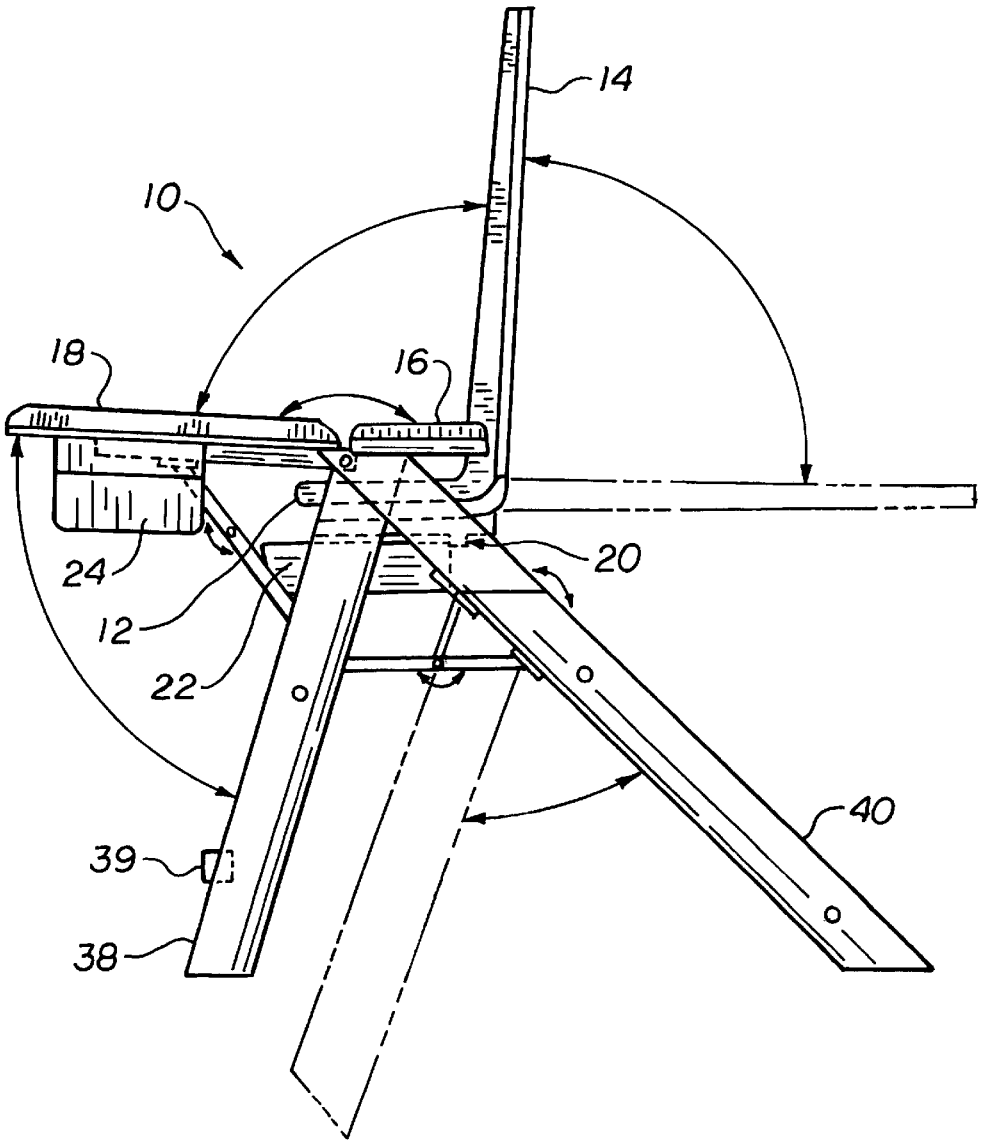
FIG. 1 is a schematic side view of a portable, collapsible chair, according to the present invention, in an examination position.
Figure 3:
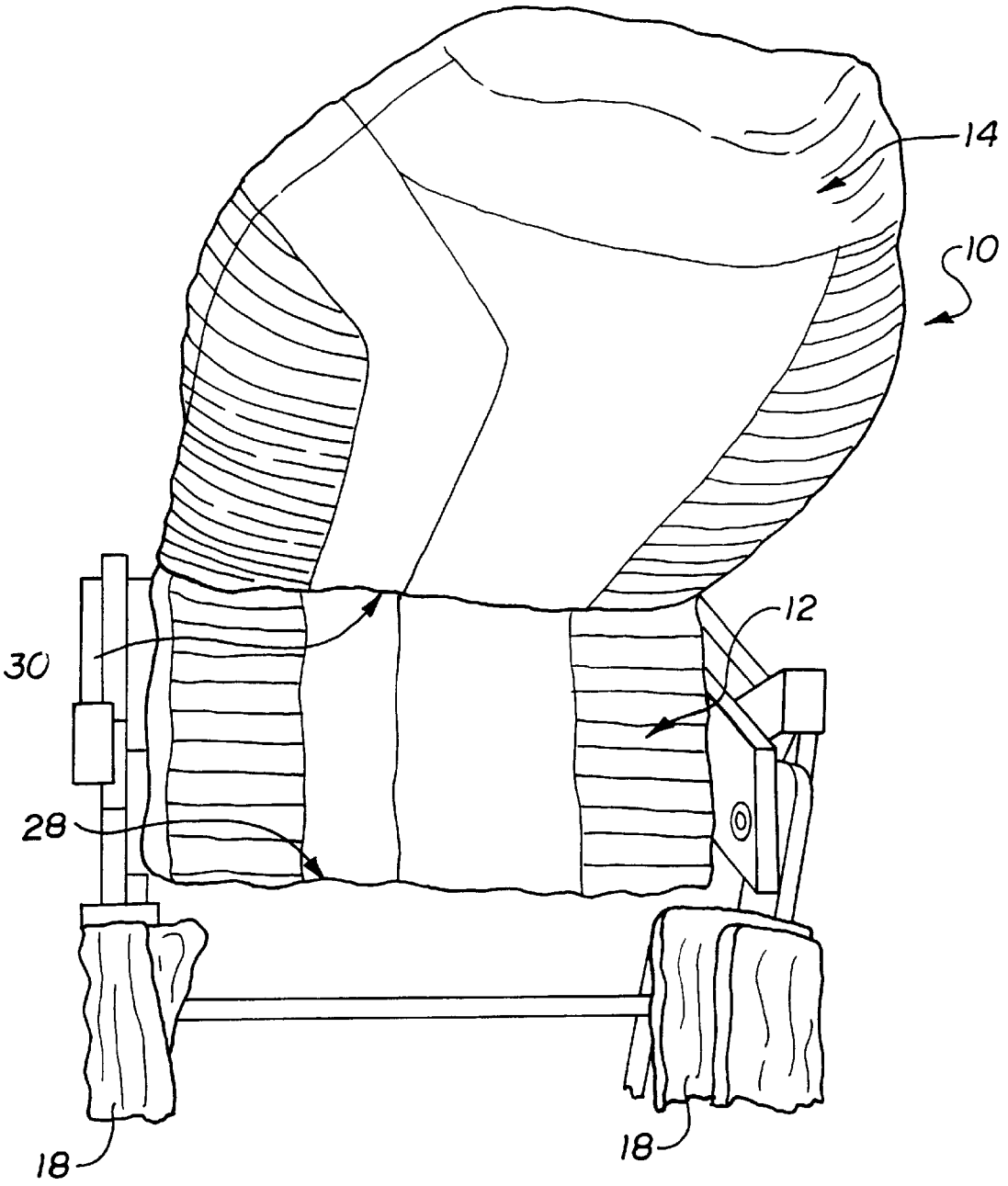
FIG. 3 is a top view of a chair according to the invention.
Figure 4:
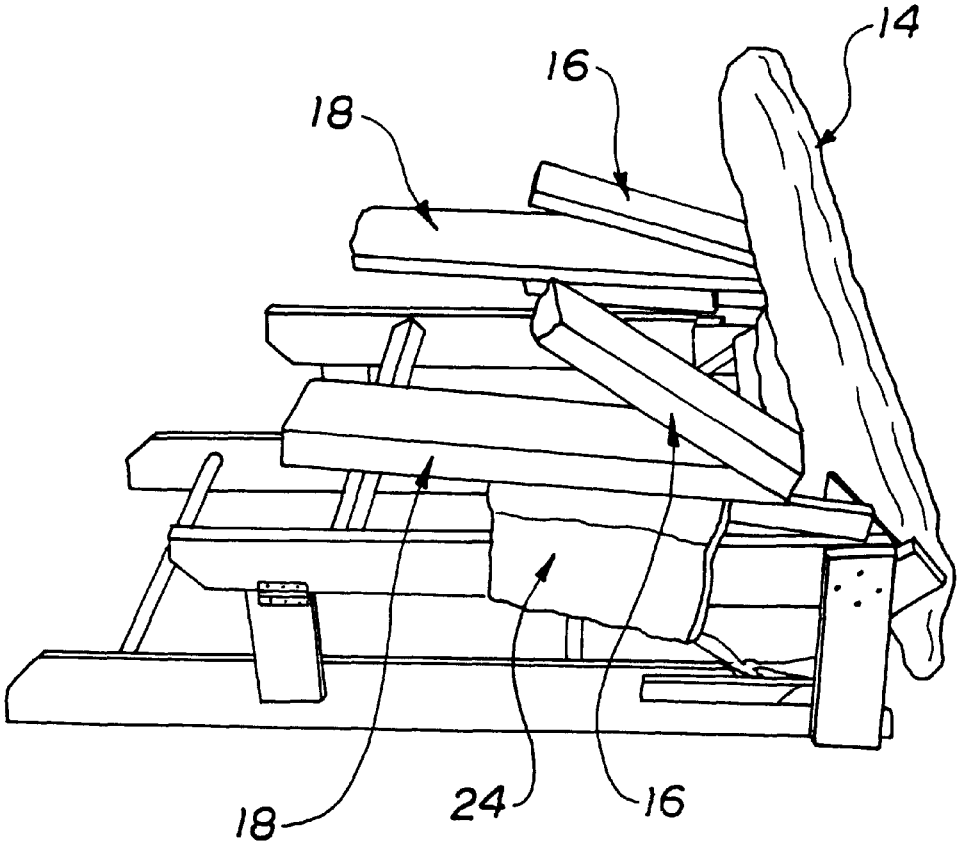
FIG. 4 is a schematic illustration of a chair according to the invention, in a collapsed position.
Figure 5:
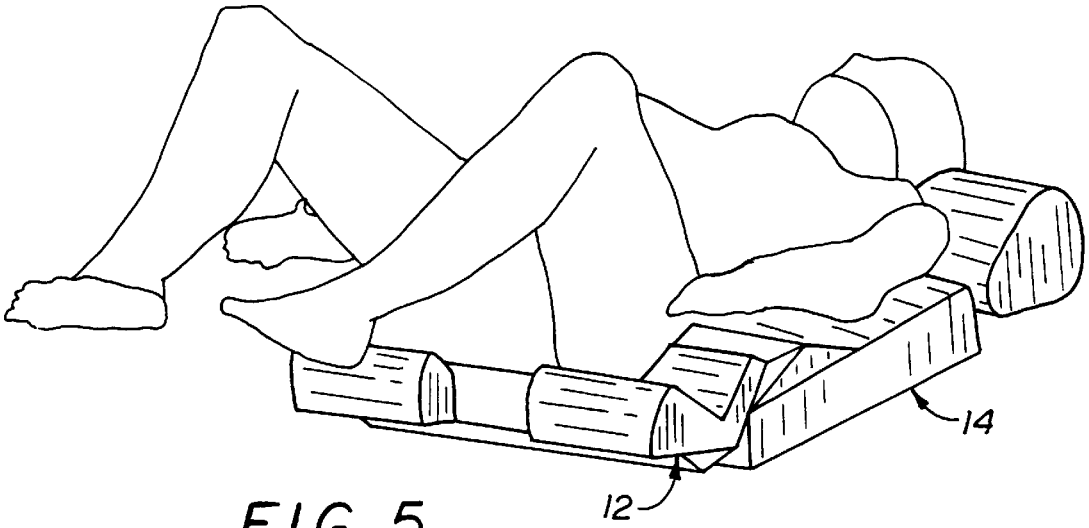
FIGS. 5–14 are schematic illustrations of a patient seated in a chair according to the present invention, in various examination positions, as described in the figure legends, with portions of the arm and/or leg rests either omitted, or schematically represented by dark black lines.
Figure 6:
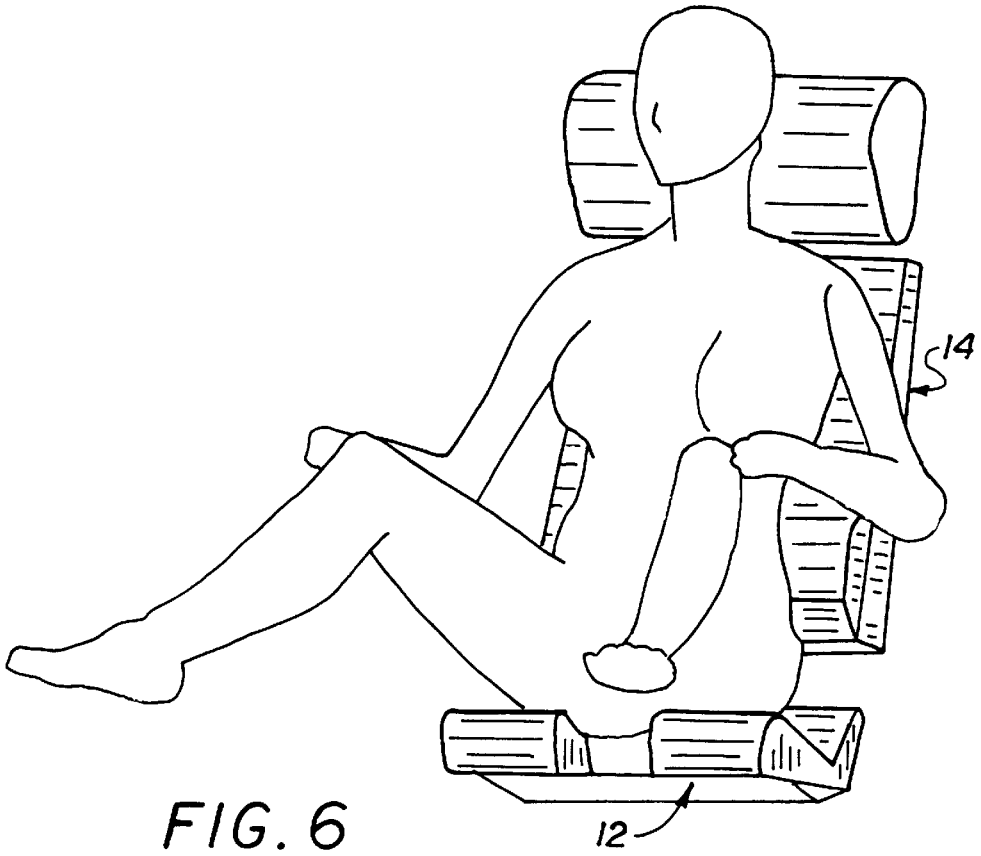
Figure 7:
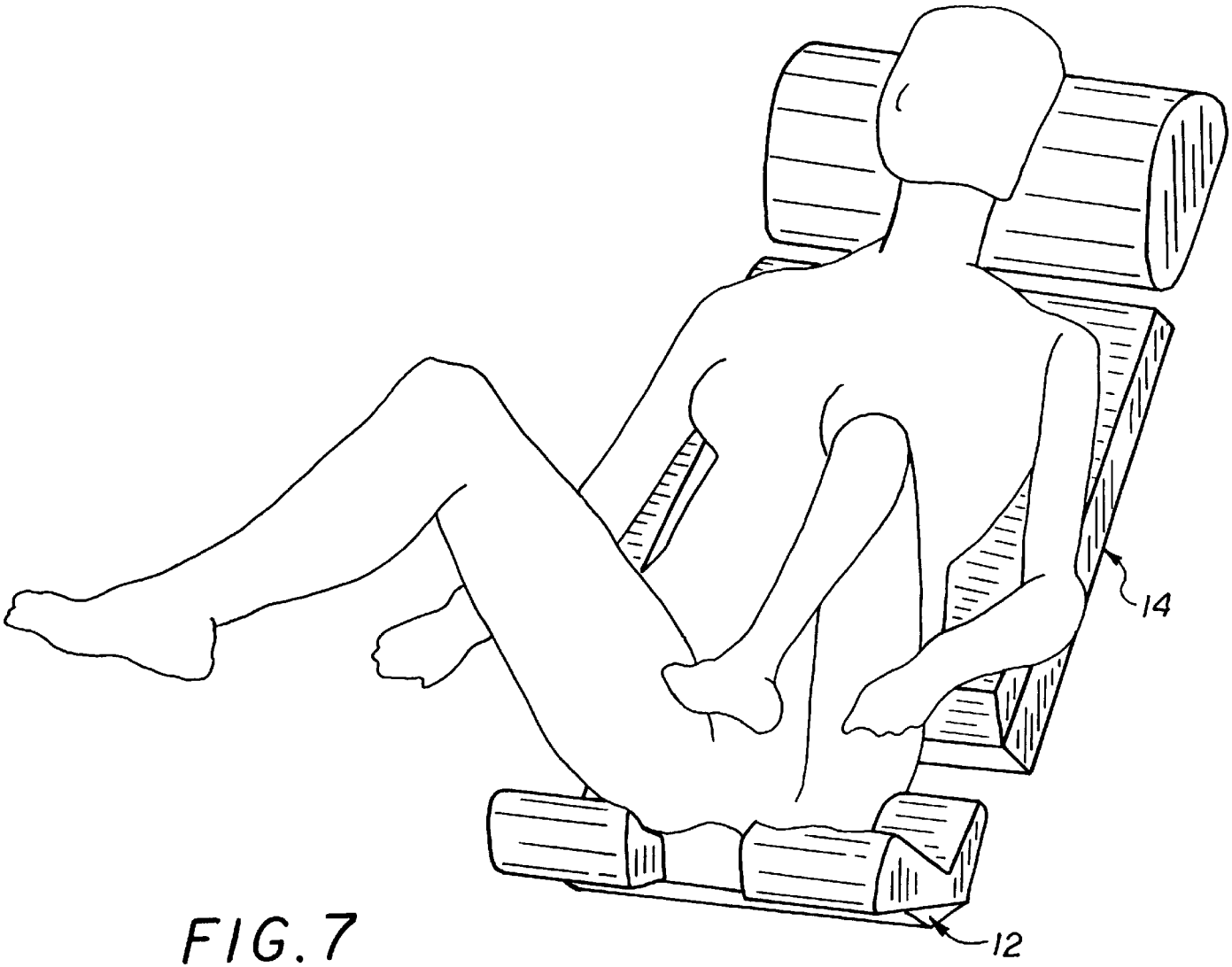
Figure 8:
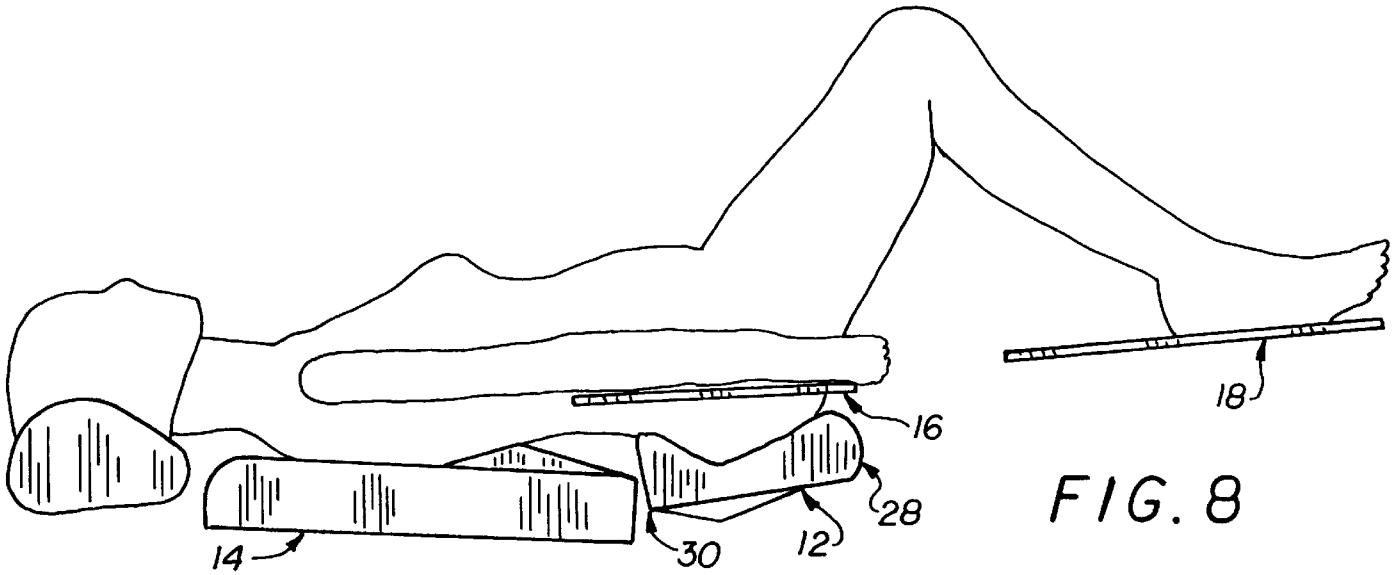
Figure 9:
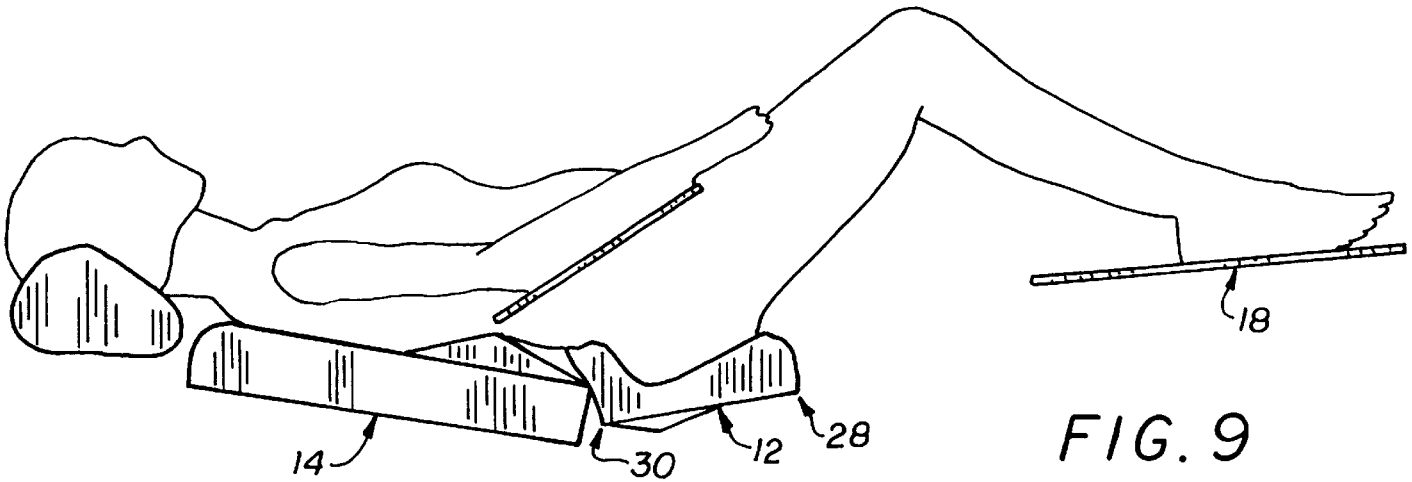
Figure 10:
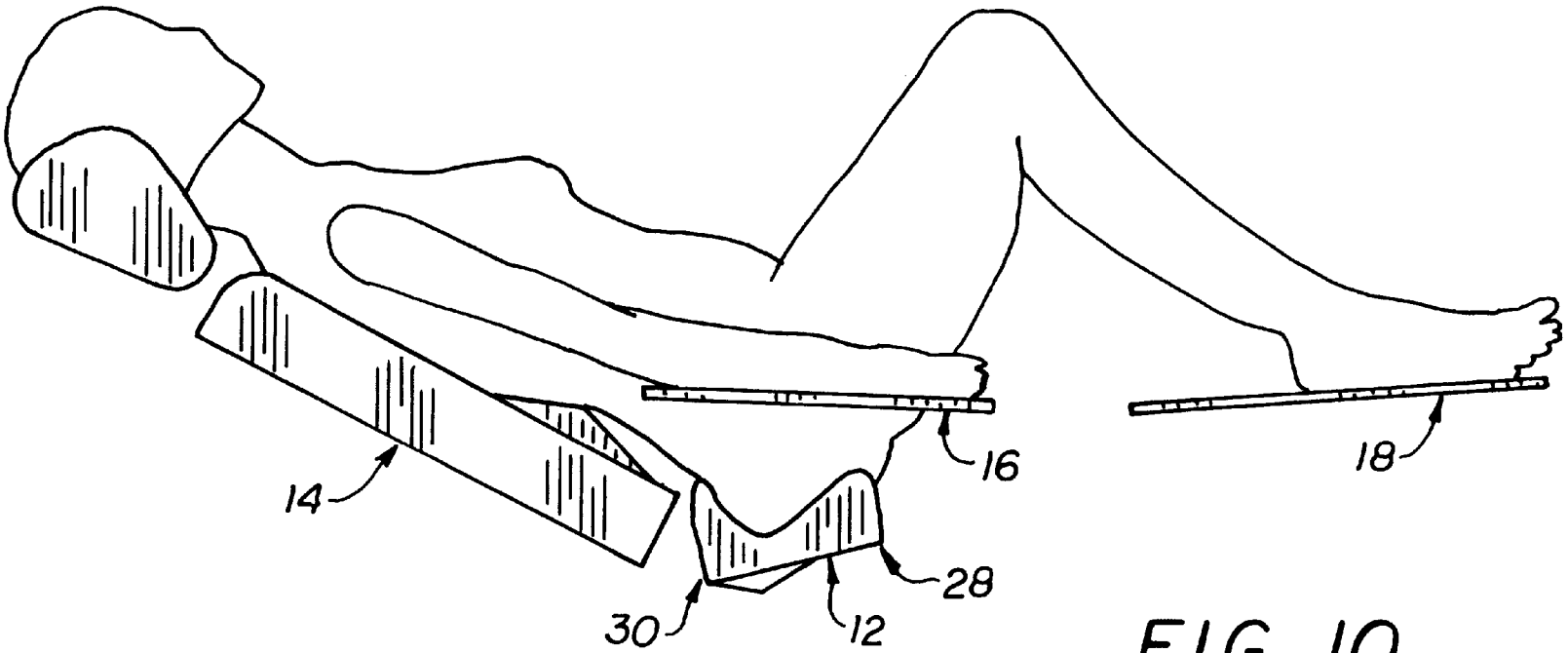
Figure 11:
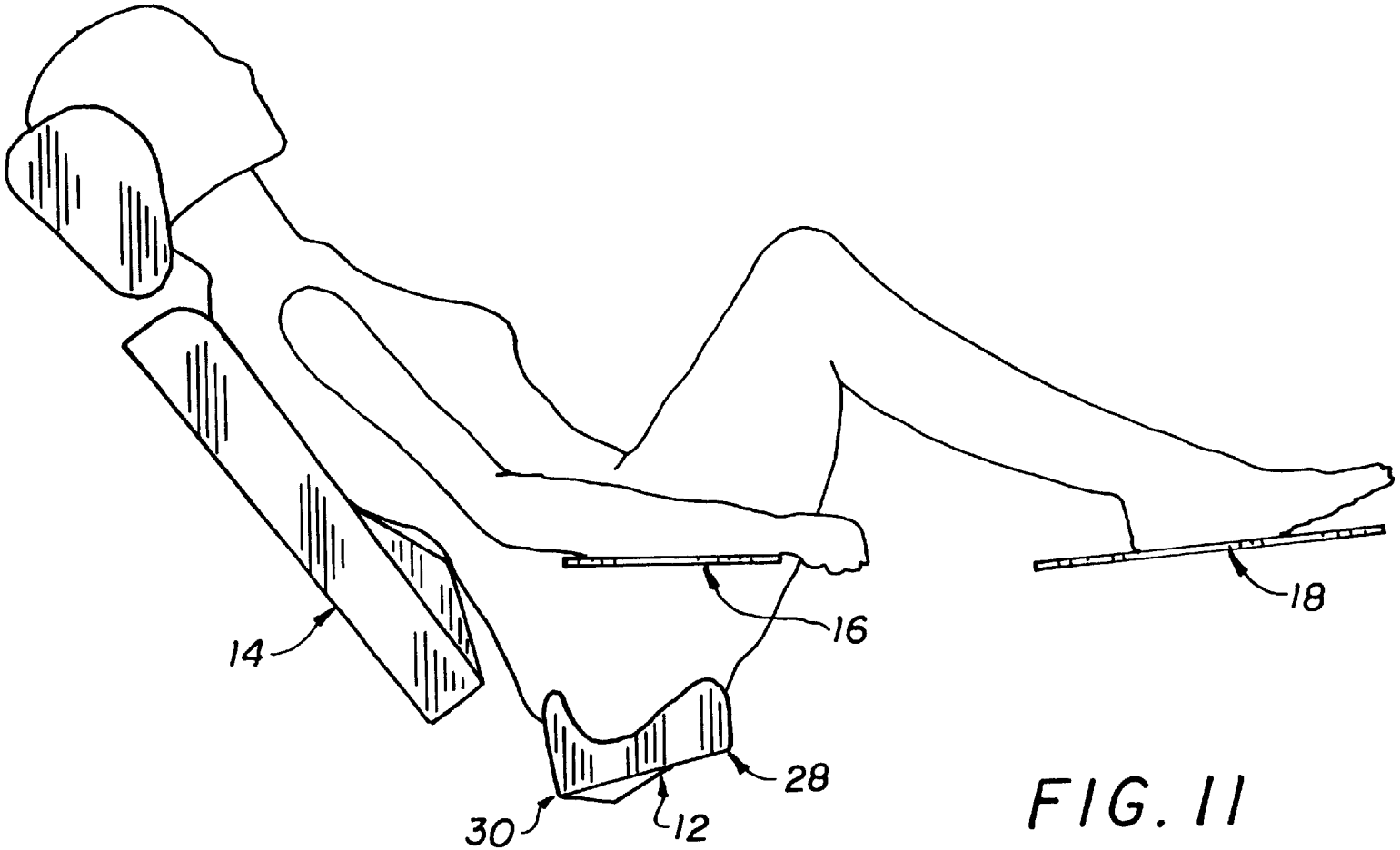
Figure 12:
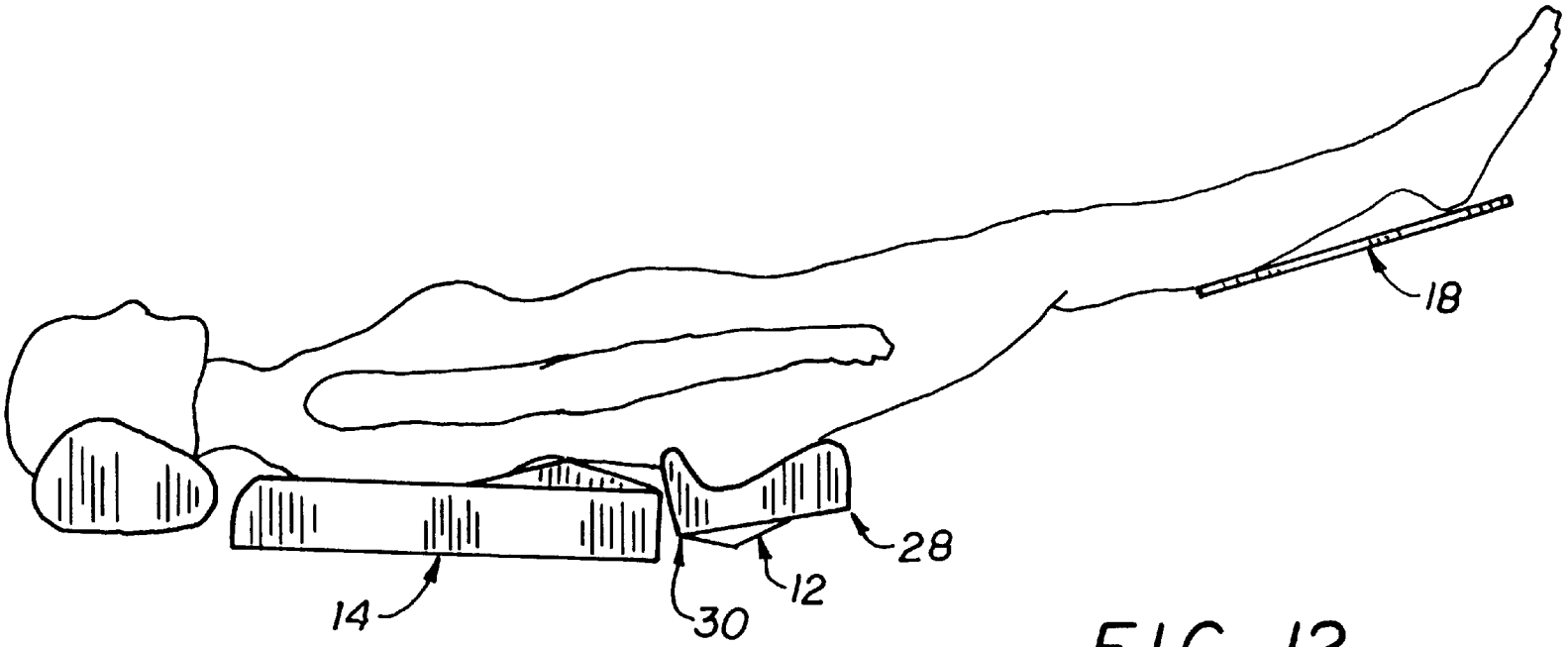
Figure 13:
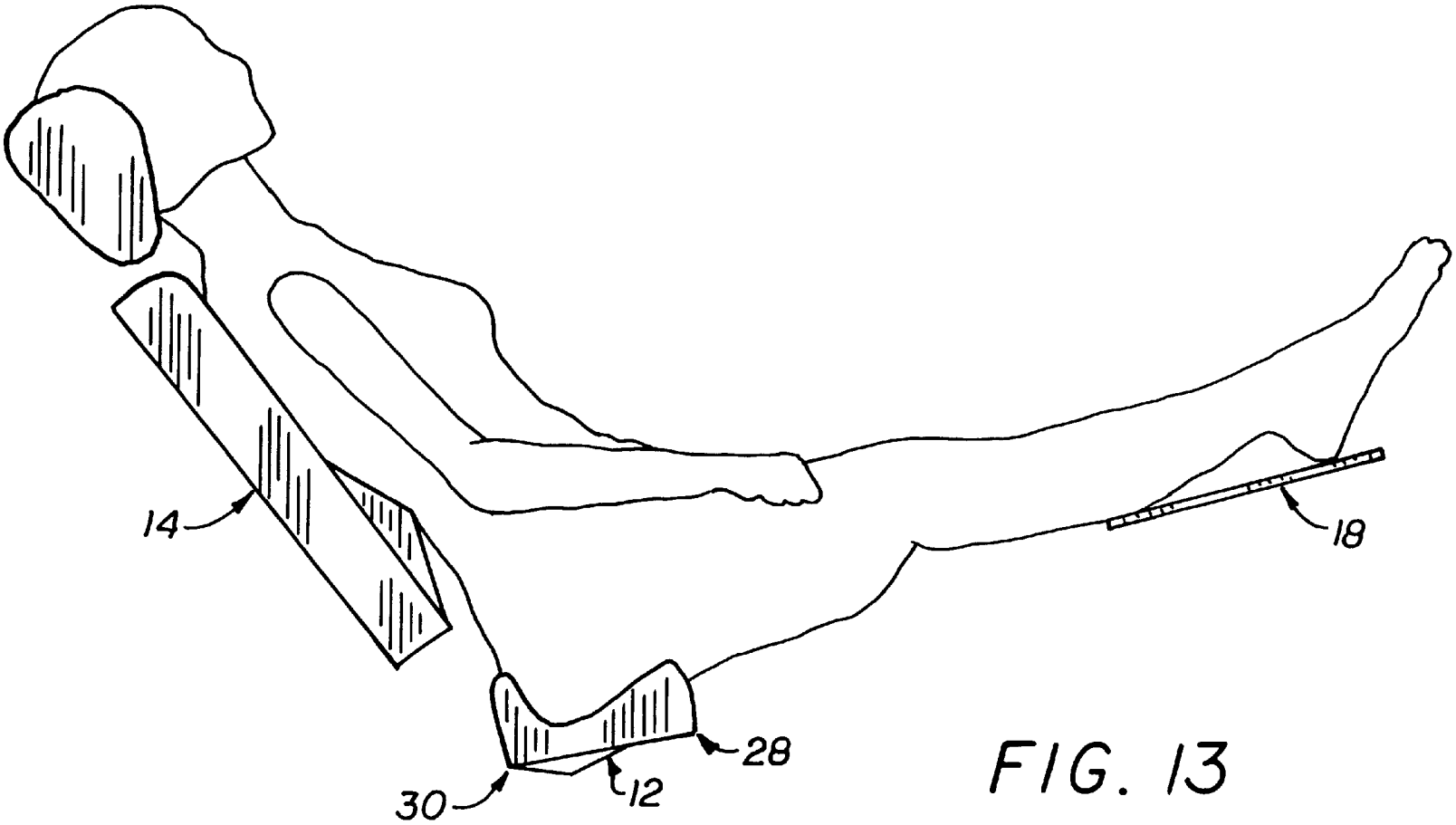
Figure 14:
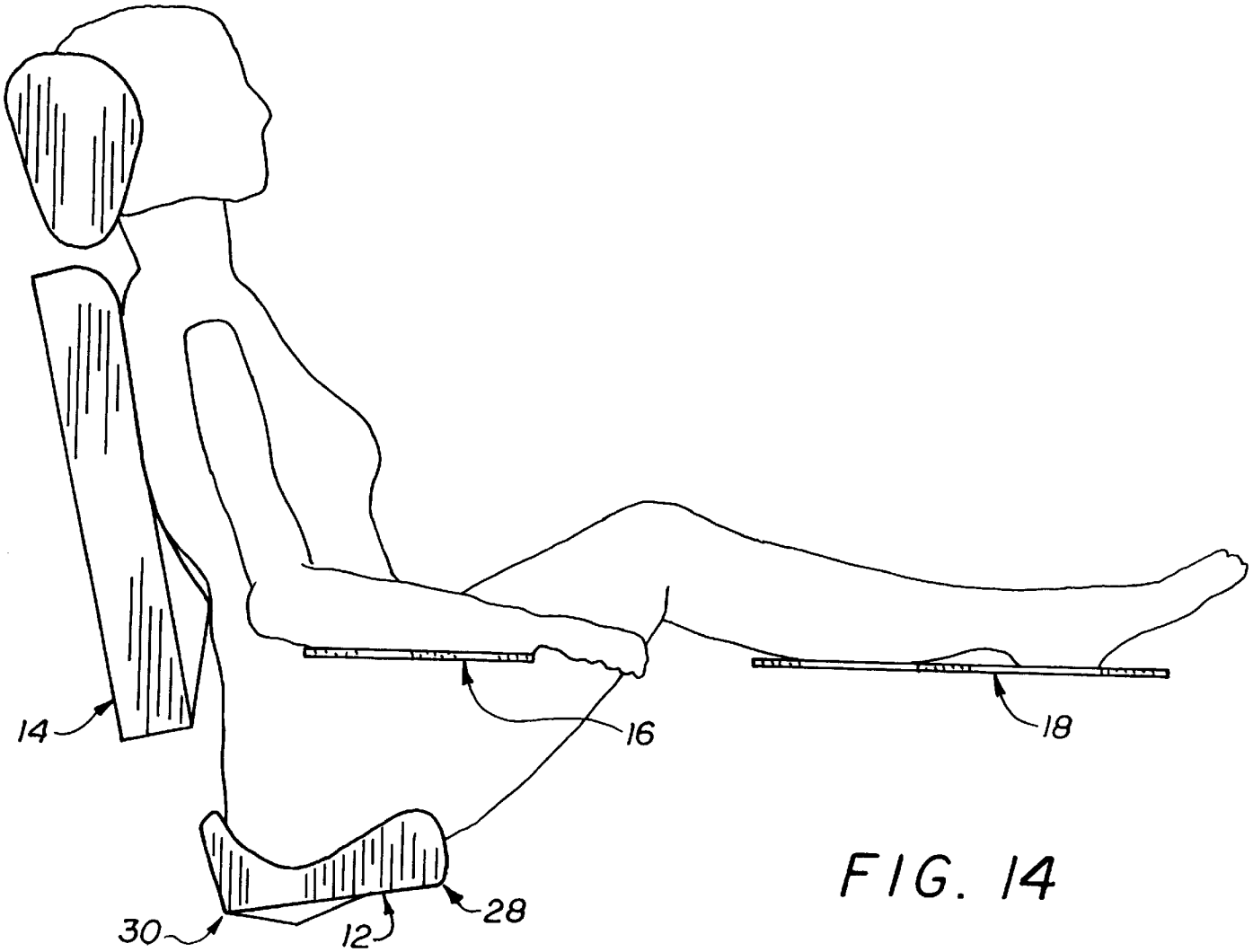
Figure 15:
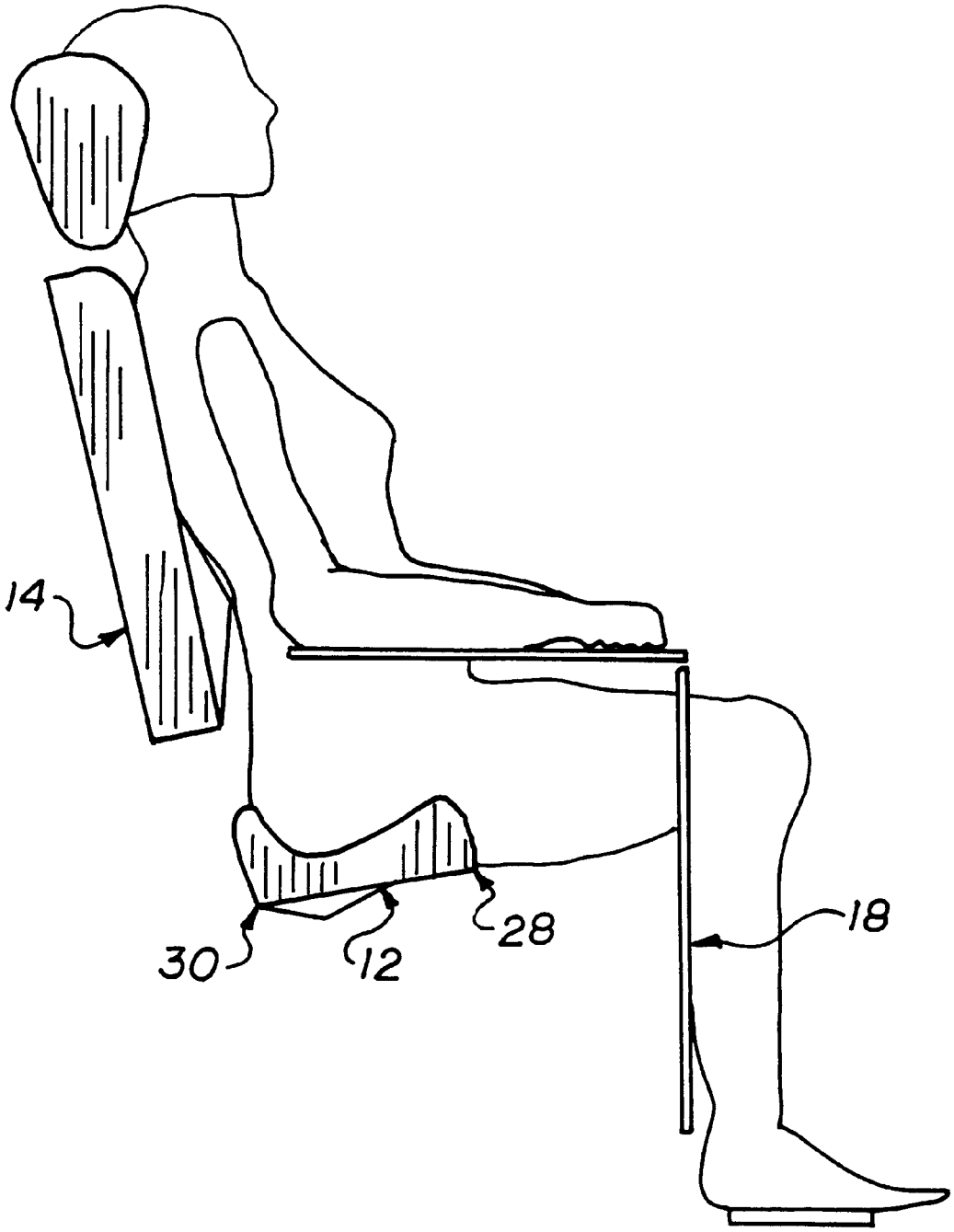
FIG. 15 is a schematic illustration of a patient seated in a chair according to the present invention, with the leg rests retracted, and the patient seated in an upright position, with feet resting on a foot rest, suitable for a general examination.

As shown in the Figures a chair 10, constructed according to the principles of the present invention, includes a seat 12, a back rest 14, a pair of arm rests 16, and a pair of leg rests 18. The chair 10 has a support structure, described below, which enables the chair to be moved between an erect position, shown in FIGS. 1, 2 and 3 and a collapsed position, shown in FIG. 4 . The underside of the seat 12 has a pair of track members 20 fixed thereto, in which to support and slide a basin or tray 22. One or both of the leg rests 18 supports a container (or bag) 24 for medical supplies related to an OB/GYN examination.

Figure 2:
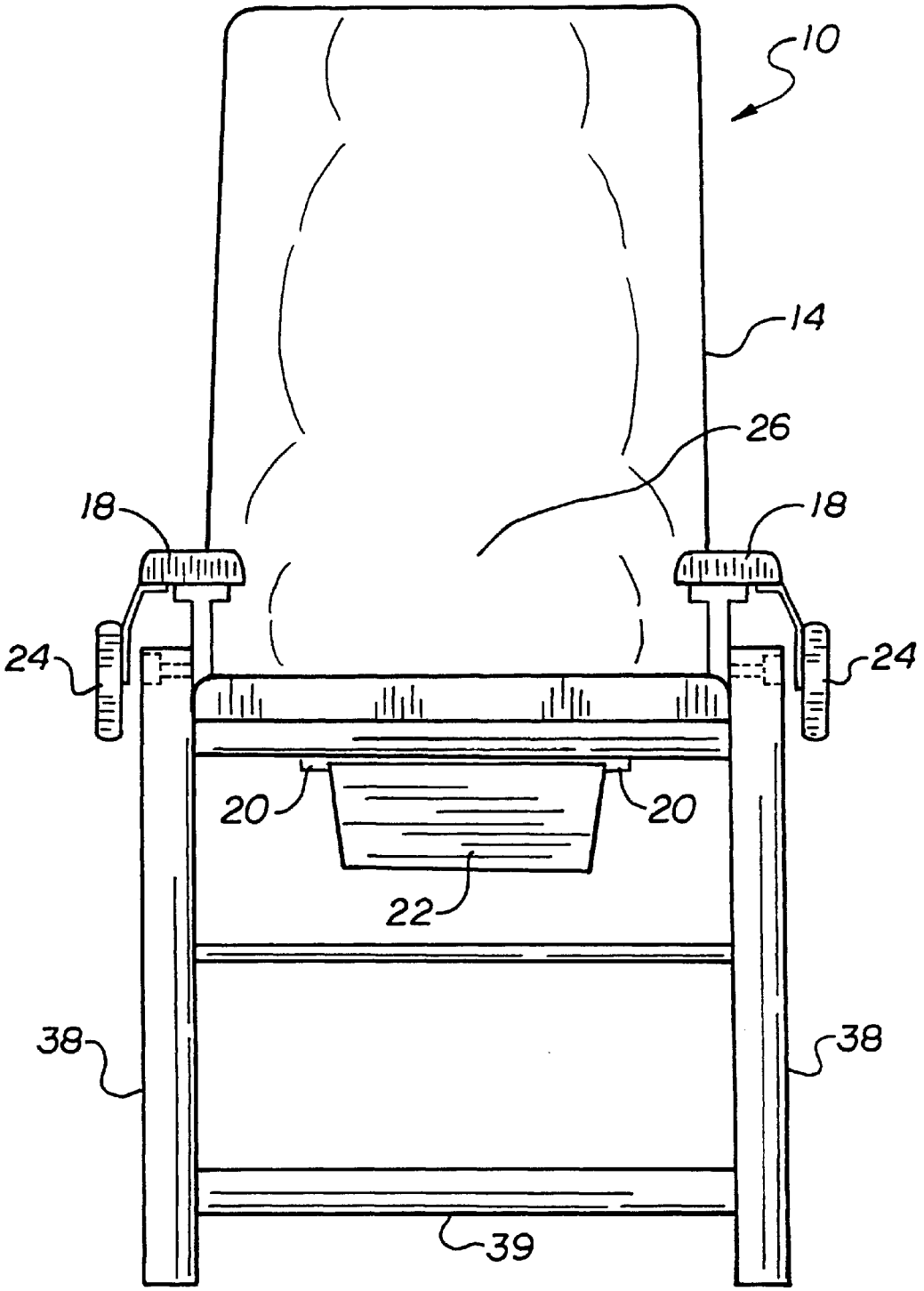
FIG. 2 is a front view of the chair of FIG. 1.

The chair 10, when in an examination position, is designed to support a patient in a dorsal lithotomy position or modified dorsal lithotomy position. To do that the back rest 14 is pivotally connected to the support structure in a manner which enables the back rest 14 to be pivoted between a substantially horizontal position (see dashed line position in FIG. 1), and one or more reclined or upright positions, in which the back rest 14 extends at an acute angle to the seat 12 (e.g. see FIGS. 9–11, 13, 14). In any of the foregoing positions, the leg rests 18 extend forward of, and preferably slightly upward from, the arm rests 16. Moreover, the leg rests 18 are spaced apart to define a space 26 therebetween (FIG. 2). In either the dorsal lithotomy position, or modified dorsal lithotomy position, the OB/GYN patient's buttocks are supported on the seat 12, the patient's feet or legs rest on top of the leg rests 18, with the patient's legs abducted.

The mechanism which enables the back rest 14 to be adjusted relative to the seat 12 is a pivotal connection between the back rest and support structure which has an associated ratchet mechanism that allows the back rest to be adjusted to various positions and maintained in such positions. The ratchet mechanism can be of a type typically found in collapsible lounge chairs, and is readily releasable when it is desired to adjust the position of the back rest.

The seat 12 has a front end (indicated generally at 28 in FIGS. 3 and 8–15) and a rear end (indicated generally at 30 in FIGS. 3 and 8–15). The back rest 14 is located adjacent the rear end 30. The length of the seat 12, i.e., from the front end 28 to the base of the back rest when the chair is in the modified dorsal lithotomy position, is relatively short, i.e., about half the length of a typical furniture chair (e.g., the seat 12 can be from about 8 to about 9 inches in length), and designed to provide support primarily for the buttocks of an average size OB/GYN patient (preferably the seat supports only the patient's buttocks, as compared to supporting the patient's buttocks and a portion of the patient's thighs). Thus, when a patient is seated, with her feet or legs resting on the leg rests 18, and her legs abducted, the seat 12 supports the patient's buttocks (preferably only the patient's buttocks), the rack rest 14 provides lumbar and upper torso support for the patient, and the patient's perineum is located substantially over the front end 28 of the chair. Thus, an OB/GYN caregiver has substantially unrestricted access to the patient's perineum, to conduct an examination and/or procedure (e.g., vaginal ultrasound). The foregoing structure is also intended to provide a relatively comfortable seated position for the patient, and as can be seen from the figures the arm rests 16 and leg rests 18 can be padded, further to enhance the patient's comfort during the examination or procedure.

The chair 10 is also adapted so that an OB/GYN caregiver can have ready access to medical supplies needed for the examination or procedure, and to collect biological discharge during the examination or procedure. Specifically, the underside of the chair has a pair of spaced apart supports 22 which support a sliding tray or basin 20. Moreover, portions of the leg rests 18 provide support for containers or bags 24 which can hang from the leg rests during the examination or procedure.

The support structure for the chair includes a pair of front supports 38, and a pair of rear supports 40, which are pivotally connected to each other. The front and rear supports are dimensioned such that when the chair is in an erect or examination position, the front supports do not appreciably restrict the OB/GYN caregiver's access to the patient's perineum. Moreover, the rear supports 40 extend rearward a sufficient distance to enable the chair to provide support for an OB/GYN patient in the dorsal lithotomy position. Also, the arm rests 16 and leg rests 18 are pivotally supported on the support structure, so as to enable the arm rests and leg rests to be pivoted to a folded up condition when the chair is in a collapsed condition, and to be pivoted to the erect or examination position. Pivotal hinges, of the type typically found in portable collapsible lounge chairs, can be used to collapse and erect the chair in the manner described herein. Moreover, a foot rest can be provided to support a patient's feet when the patient is seated in an upright position. In FIG. 2, the foot rest comprises a horizontal bar 39 extending between the front supports 38.

Further details of the structure and the manner of collapsing, erecting and using the chair are shown in the photographs of Exhibits A–C.

It should also be noted that a chair according to the present invention is intended to be comfortable for the patient undergoing the examination or procedure, and requires a minimum of positional adjustment by the patient for the conduct of a full physical examination. For example, the arm rests 16 and the leg rests 18 are padded, to enhance the comfort of the chair. Moreover, it will be apparent to an OB/GYN caregiver that parts of a full physical examination can be performed with a patient sitting upright with her feet resting on the lower foot support 39 or on the ground. Other parts of a full physical examination can be performed with the patient supine, with her legs extended and resting on the spaced apart leg rests 18. Still further, the leg rests 18 are pivotal between a retracted position and an extended position. In the retracted position (FIG. 15), the leg rests 18 are pivoted to a position in which they are completely clear of a caregiver and enable the patient to be seated in a upright position during the full physical examination. Moreover, when the leg rests are in the extended position, and the back is adjustable to enable the patient to be supine for the full physical examination.

Accordingly, there has been described herein a new and useful chair which is collapsible for storage and/or transport and which can be erected to an examination position in which it is particularly suited for supporting an OB/GYN patient in a relatively comfortable position in which an OB/GYN caregiver can conveniently and effectively conduct an OB/GYN examination and/or procedure. With the disclosure in mind, it is believed that ways of constructing a chair for the foregoing purposes will become readily apparent to those in the art.

What is claimed is:

1. A portable, collapsible chair for performing an OB/GYN examination or procedure, comprising a collapsible chair structure having a seat, a back rest, a pair of armrests and a pair of substantially planar leg rests, said chair being moveable between a collapsed condition for storage and/or transport and an examination position in which it enables a patient to be seated in a position suitable for an OB/GYN examination or procedure, said chair when in said examination position a. having said seat and back rest adapted to provide support for a patient's torso;

b. having said pair of arm rests spaced apart and oriented to provide support for the patient's arms; and c. having said pair of substantially planar leg rests extending forwardly of said pair of arm rests and said seat, oriented to provide support for the backs of the patient's legs, and being spaced apart from each other to enable a patient to be supported with her legs in an abducted position suitable for an OB/GYN examination and defining therebetween an examination space in which an OB/GYN caregiver can perform an OB/GYN examination or procedure.

2. A chair as set forth in claim 1, wherein said seat has a front end and a rear end, and said back rest extends away from said rear end, said seat being dimensioned so as to provide support for a patient's buttocks and to position the perineum of a patient substantially above said front end when said chair is in said examination position, so that an OB/GYN caregiver has substantially unobstructed access to a patient's perineum when a patient is seated in the chair with the patient's legs supported thereon in an abducted position, and said back rest is disposed to provide lumbar and upper torso support for the patient.

3. A chair as set forth in claim 2, wherein said back rest is adjustable for enabling a patient to be supported in different positions between a dorsal lithotomy position and an upright, modified dorsal lithotomy position when said chair is in said examination position.

4. A chair as set forth in claim 3, wherein said seat, back rest, arm rests and leg rests are integrally and pivotally linked with each other in a manner that enables them to be moveable between said collapsed condition and said examination position.

5. A chair as set forth in claim 3, wherein said seat has support structure which enables a slidable basin to be integrally connected with said seat.

6. A chair as set forth in claim 5, further including support structure for medical supplies for an OB/GYN examination.

7. A chair as set forth in chair 2, wherein said seat has support structure which enables a slidable basin to be integrally connected with said seat.

8. A chair as set forth in claim 1, wherein said back rest is adjustable for enabling a patient to be supported in different positions between a dorsal lithotomy position and an upright, modified dorsal lithotomy position when said chair is in said examination position.

9. A chair as set forth in claim 1, wherein said seat has support structure which enables a slidable basin to be integrally connected with said seat.

10. A chair as set forth in any of claims 3–6 and 8, wherein said leg rests are pivotal between a retracted position and an extended position when said chair is in said examination position, said leg rests when in said retracted position being substantially clear of a patient's legs while the patient is seated on said seat and enabling the patient to be seated in an upright position on said seat for a complete physical examination.

11. A chair as set forth in claim 10, wherein said chair further comprises a lower foot rest separate from said leg rests for supporting a patient's feet when the patient is seated in the upright position.

12. A chair as set forth in claim 1, wherein said substantially planar leg rests are substantially planar from their respective attachment points with the rest of said chair.

13. A chair as set forth in claim 4, wherein said substantially planar leg rests are substantially planar from their respective attachment points with the rest of said chair.

14. A chair as set forth in claim 1, wherein said substantially planar leg rests are oriented to provide support for the backs of at least the patient's calves and the patient's heels.

15. A chair as set forth in claim 2, wherein said chair further comprises seat support structure operatively connected to said seat, said seat support structure comprising a front support pivotally connected to a rear support, said front and rear supports extending down to whatever surfaces support said chair.

16. A chair as set forth in claim 15, wherein said front support comprises first and second front support legs, said first and second front support legs having a lower foot rest separate from said leg rests and extending between said first and second front support legs, said foot rest providing support for the patient's feet when the patient is seated in the upright position.

17. A chair as set forth in claim 15, wherein said substantially planar leg rests are substantially planar from their respective attachment points with the rest of said chair.

18. A chair as set forth in claim 15, wherein (i) said substantially planar leg rests are oriented to provide support for the backs of at least the calves of the patient's legs and (ii) said front support comprises first and second front support legs, said first and second front support legs having a lower foot rest separate from said leg rests and extending between said first and second front support legs, said foot rest providing support for the patient's feet when the patient is seated in the upright position.

19. A chair as set forth in claim 18, wherein said substantially planar leg rests are substantially planar from their respective attachment points with the rest of said chair.

20. A chair as set forth in claim 2, wherein said seat is from about 8 to about 9 inches in length from the back of the seat to the front of the seat below the patient's perineum.

21. A chair as set forth in claim 15, wherein said seat is from about 8 to about 9 inches in length from the back of the seat to the front of the seat below the patient's perineum.

22. A chair as set forth in claim 18, wherein said seat is from about 8 to about 9 inches in length from the back of the seat to the front of the seat below the patient's perineum.

23. A chair as set forth in claim 19, wherein said seat is from about 8 to about 9 inches in length from the back of the seat to the front of the seat below the patient's perineum.

24. A chair as set forth in claim 18, wherein at least one of said arm rests has connected thereto a support structure for medical supplies for an OB/GYN examination.

25. A chair as set forth in claim 18, wherein at least one of said leg rests has connected thereto a support structure for medical supplies for an OB/GYN examination.

26. A chair as set forth in claim 18, wherein at least one of said leg rests has connected thereto a container for medical supplies for an OB/GYN examination.

27. A chair as set forth in claim 18, wherein at least one of said leg rests has connected thereto a pouch for medical supplies for an OB/GYN examination.

28. A chair as set forth in claim 1, wherein said pair of leg rests comprise first and second substantially planar leg rests and said pair of arm rests comprise first and second substantially planar arm rests, said first substantially planar leg rest being operatively connected directly to said first substantially planar arm rest, and said second substantially planar leg rest being operatively connected directly to said second substantially planar arm rest.

29. A chair as set forth in claim 28, wherein said first substantially planar leg rest is hinged to said first substantially planar arm rest, and said second substantially planar leg rest is hinged directly to said second substantially planar arm rest.

30. A chair as set forth in claim 15, wherein said pair of leg rests comprise first and second substantially planar leg rests and said pair of arm rests comprise first and second substantially planar arm rests, said first substantially planar leg rest being operatively connected directly to said first substantially planar arm rest, and said second substantially planar leg rest being operatively connected directly to said second substantially planar arm rest.

31. A chair as set forth in claim 30, wherein said first substantially planar leg rest is hinged to said first substantially planar arm rest, and said second substantially planar leg rest is hinged directly to said second substantially planar arm rest.

32. A chair as set forth in claim 18, wherein said pair of leg rests comprise first and second substantially planar leg rests and said pair of arm rests comprise first and second substantially planar arm rests, said first substantially planar leg rest being operatively connected directly to said first substantially planar arm rest, and said second substantially planar leg rest being operatively connected directly to said second substantially planar arm rest.

33. A chair as set forth in claim 32, wherein said first substantially planar leg rest is hinged to said first substantially planar arm rest, and said second substantially planar leg rest is hinged directly to said second substantially planar arm rest.

34. A chair as set forth in claim 1, wherein said substantially planar leg rests are padded for patient comfort.

35. A chair as set forth in claim 4, wherein said substantially planar leg rests are padded for patient comfort.

36. A chair as set forth in claim 15, wherein said substantially planar leg rests are padded for patient comfort.

37. A chair as set forth in claim 18, wherein said substantially planar leg rests are padded for patient comfort.

38. A chair as set forth in claim 33, wherein said substantially planar leg rests are padded for patient comfort.

39. A chair as set forth in claim 1, wherein said chair comprises a surface oriented to provide support for the patient's head.

40. A chair as set forth in claim 2, wherein said chair comprises a surface oriented to provide support for the patient's head.

41. A chair as set forth in claim 15, wherein said chair comprises a surface oriented to provide support for the patient's head.

42. A chair as set forth in claim 18, wherein said chair comprises a surface oriented to provide support for the patient's head.

43. A chair as set forth in claim 38, wherein said chair comprises a surface oriented to provide support for the patient's head.

44. A portable, collapsible chair for performing an OB/GYN examination or procedure, comprising a collapsible chair structure having a seat, a back rest, and a pair of substantially planar leg rests, said chair being moveable between a collapsed condition for storage and/or transport and an examination position in which it enables a patient to be seated in a position suitable for an OB/GYN examination or procedure, said chair when in said examination position a. having said seat and back rest adapted to provide support for the patient's torso; and b. having said pair of substantially planar leg rests extending forwardly of said seat, oriented to provide support for the backs of the patient's legs, and being spaced apart from each other to enable a patient to be supported with her legs in an abducted position suitable for an OB/GYN examination and defining therebetween an examination space in which an OB/GYN caregiver can perform an OB/GYN examination or procedure.

* * * * *